US010246290B2

(12) United States Patent
Hirata et al.

(10) Patent No.: US 10,246,290 B2
(45) Date of Patent: Apr. 2, 2019

(54) CONVEYING APPARATUS AND TRAY UNIT

(71) Applicant: BROTHER KOGYO KABUSHIKI KAISHA, Nagoya-shi, Aichi-ken (JP)

(72) Inventors: Kenichi Hirata, Nagoya (JP); Masayuki Okumura, Nagoya (JP); Tadanobu Chikamoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/439,143

(22) Filed: Feb. 22, 2017

(65) Prior Publication Data

US 2017/0283203 A1 Oct. 5, 2017

(30) Foreign Application Priority Data

Mar. 31, 2016 (JP) ..... 2016-070227

(51) Int. Cl.
*B65H 31/24* (2006.01)
*B65H 31/32* (2006.01)
*B65H 39/11* (2006.01)

(52) U.S. Cl.
CPC ..... *B65H 31/32* (2013.01); *B65H 31/24* (2013.01); *B65H 39/11* (2013.01); *B65H 2402/31* (2013.01); *B65H 2405/11151* (2013.01); *B65H 2405/332* (2013.01); *B65H 2405/35* (2013.01); *B65H 2405/353* (2013.01); *B65H 2801/27* (2013.01)

(58) Field of Classification Search
CPC .... B65H 2301/166; B65H 2405/11151; B65H 2405/1111; B65H 2405/332; B65H 2405/35; B65H 2405/353; B65H 31/02; B65H 31/04; B65H 31/30; B65H 39/11
See application file for complete search history.

(56) References Cited

U.S. PATENT DOCUMENTS 4,880,223 A * 11/1989 Yamazaki ..... B65H 39/11 271/293
5,099,292 A * 3/1992 Hirose ..... B42C 1/125 270/37
6,112,047 A * 8/2000 Kato ..... B65H 29/00 271/279

FOREIGN PATENT DOCUMENTS

| | | | |
|---|---|---|---|
| JP | 63-26663 | U | 2/1988 |
| JP | 2-56354 | A | 2/1990 |
| JP | 6-85981 | A | 3/1994 |
| JP | 2007-119172 | A | 5/2007 |
| JP | 4204934 | B2 | 1/2009 |

* cited by examiner

*Primary Examiner* — Howard J Sanders
(74) *Attorney, Agent, or Firm* — Merchant & Gould P.C.

(57) ABSTRACT

A conveying apparatus includes: receiving trays arranged vertically and has a lowest tray and a first receiving tray; a conveying mechanism; a supporter supporting the receiving trays; and a swing mechanism configured to swing the first receiving tray with respect to the supporter to one of a receiving position at which the first receiving tray receives a medium and an upper position. The swing mechanism is configured to: keep the first receiving tray at the upper position when a first external force directed in a direction in which the first receiving tray is moved from the upper position toward the receiving position is not applied to the first receiving tray located at the upper position; and swing the first receiving tray with respect to the supporter toward the receiving position when the first external force is applied to the first receiving tray.

9 Claims, 9 Drawing Sheets

CONVEYING APPARATUS AND TRAY UNIT

CROSS REFERENCE TO RELATED APPLICATION

The present application claims priority from Japanese Patent Application No. 2016-070227, which was filed on Mar. 31, 2016, the disclosure of which is herein incorporated by reference in its entirety.

BACKGROUND

The following disclosure relates to a conveying apparatus comprising a plurality of receiving trays arranged in a vertical direction, and to a tray unit used for the conveying apparatus.

There is known conveying apparatuses each including a plurality of receiving trays arranged in a vertical direction. One example of the conveying apparatuses is a sheet discharge apparatus including four output trays (receiving trays) arranged in the vertical direction. Each of the four output trays includes a tray body and a stopper projecting from an upper surface of the tray body. The stopper is pivotable with respect to the tray body between a stopping position and a position at which the stopper does not protrude from the upper surface of the tray body. When a user takes out a sheet placed on the tray body, the stopper is moved from the stopping position to the position at which the stopper does not protrude from the upper surface of the tray body, preventing the sheet from being caught by the stopper.

SUMMARY

In the above-described construction, however, since each of the receiving trays is fixed to the apparatus, the size of a space between the receiving trays decreases with decrease in size of the apparatus, making it difficult for the user to take out a medium (a short medium in a conveying direction in particular) from each of receiving trays (lower trays) different from the uppermost tray.

To solve this problem, the inventors of the present application have developed a construction in which receiving trays include the lowest tray and at least one tray (upper tray) different from the lowest tray, and the upper tray is swingable with respect to a supporter of an apparatus so as for the user to easily take out the medium from a lower tray disposed under the upper tray. This construction makes it possible to enlarge a working space by moving the upper tray from a receiving position to an upper position when the medium is taken out from the lower tray. The receiving position is a position at which the receiving tray receives the medium conveyed by a conveying mechanism. A position of a downstream end of the receiving tray in the conveying direction when the medium conveyed by the conveying mechanism is received by the receiving tray is higher when the receiving tray is located at the upper position than when the receiving tray is located at the receiving position.

However, in the case where the upper tray is kept at the upper position after the medium is taken out in the state in which the upper tray is situated at the upper position, it is difficult for the user to take out the medium received by the upper tray.

Accordingly, an aspect of the disclosure relates to a conveying apparatus and a tray unit allowing a user to easily take out a medium from any of a lower tray and an upper tray.

In one aspect of the disclosure, a conveying apparatus includes: a plurality of receiving trays each having a receiving surface that receives a medium, the plurality of receiving trays being arranged in a vertical direction, the plurality of receiving trays including (i) a lowest tray located at a lowest position among the plurality of receiving trays and (ii) a first receiving tray that is each of at least one of the plurality of receiving trays other than the lowest tray; a conveying mechanism configured to convey the medium to the receiving surface of one of the plurality of receiving trays, selectively; a supporter supporting the plurality of receiving trays; and a swing mechanism configured to swing the first receiving tray with respect to the supporter so as to move the first receiving tray selectively to one of a receiving position at which the first receiving tray receives the medium conveyed by the conveying mechanism and an upper position at which a position of a downstream end of the first receiving tray in a conveying direction in which the medium is conveyed by the conveying mechanism is higher than a position of the downstream end of the first receiving tray located at the receiving position. The swing mechanism is configured to: keep the first receiving tray at the upper position when a first external force that is an external force directed in a direction in which the first receiving tray is moved from the upper position toward the receiving position is not applied to the first receiving tray located at the upper position; and swing the first receiving tray with respect to the supporter toward the receiving position when the first external force is applied to the first receiving tray.

Another aspect of the disclosure relates to a tray unit used for a conveying apparatus. The conveying apparatus includes (a) a plurality of receiving trays each having a receiving surface that receives a medium, the plurality of receiving trays being arranged in a vertical direction, (b) a conveying mechanism configured to convey the medium to the receiving surface of one of the plurality of receiving trays, selectively, and (c) a supporter supporting the plurality of receiving trays. The tray unit includes: the plurality of receiving trays including (i) a lowest tray located at a lowest position among the plurality of receiving trays and (ii) a first receiving tray that is each of at least one of the plurality of receiving trays other than the lowest tray; and a swing mechanism configured to swing the first receiving tray with respect to the supporter so as to move the first receiving tray selectively to one of a receiving position at which the first receiving tray receives the medium conveyed by the conveying mechanism and an upper position at which a position of a downstream end of the first receiving tray in a conveying direction in which the medium is conveyed by the conveying mechanism is higher than a position of the downstream end of the first receiving tray located at the receiving position. The swing mechanism is configured to: keep the first receiving tray at the upper position when a first external force that is an external force directed in a direction in which the first receiving tray is moved from the upper position toward the receiving position is not applied to the first receiving tray located at the upper position; and swing the first receiving tray with respect to the supporter toward the receiving position when the first external force is applied to the first receiving tray.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Figure 1:
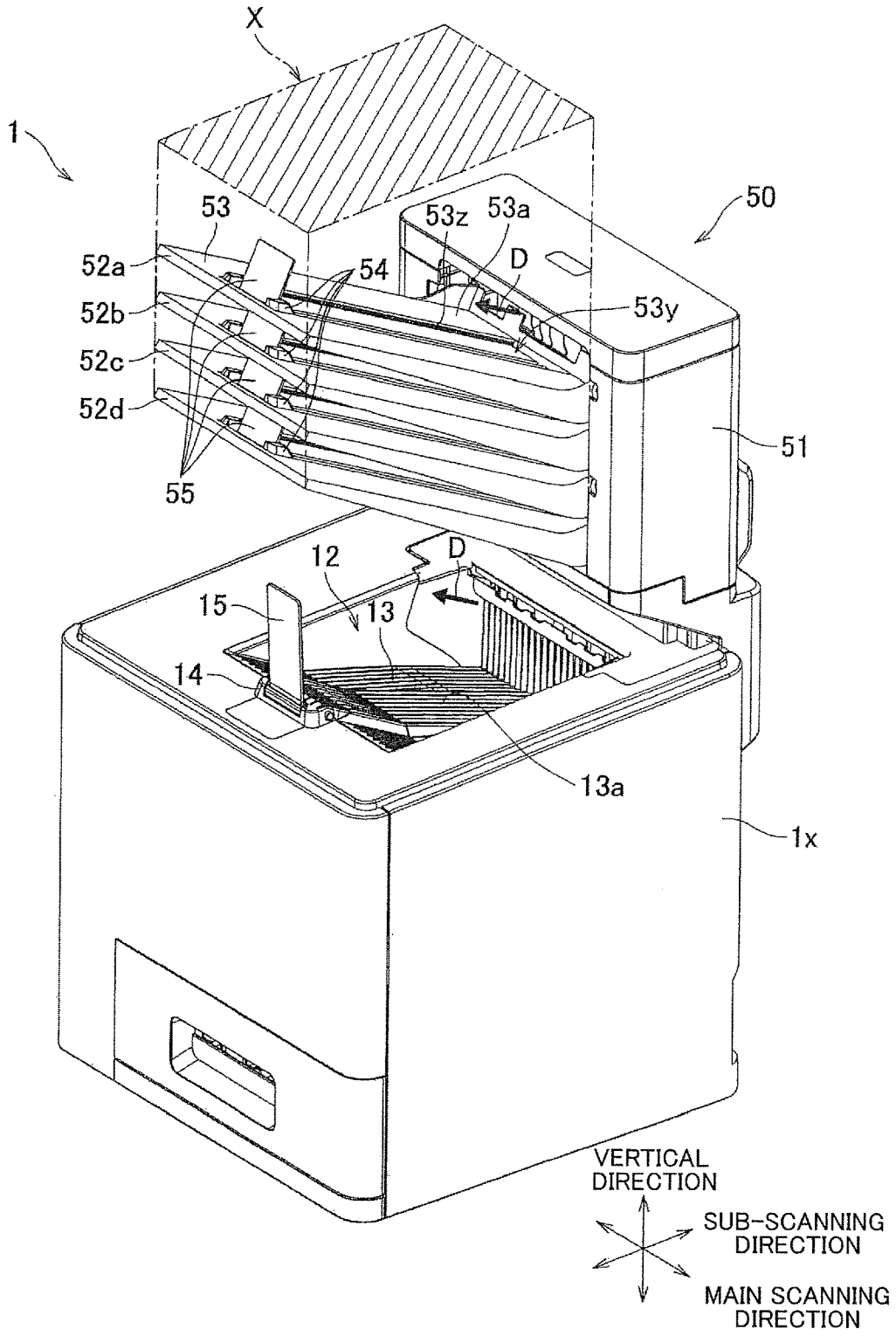
FIG. 1 is a perspective view of an ink-jet printer according to a first embodiment.
Figure 2:
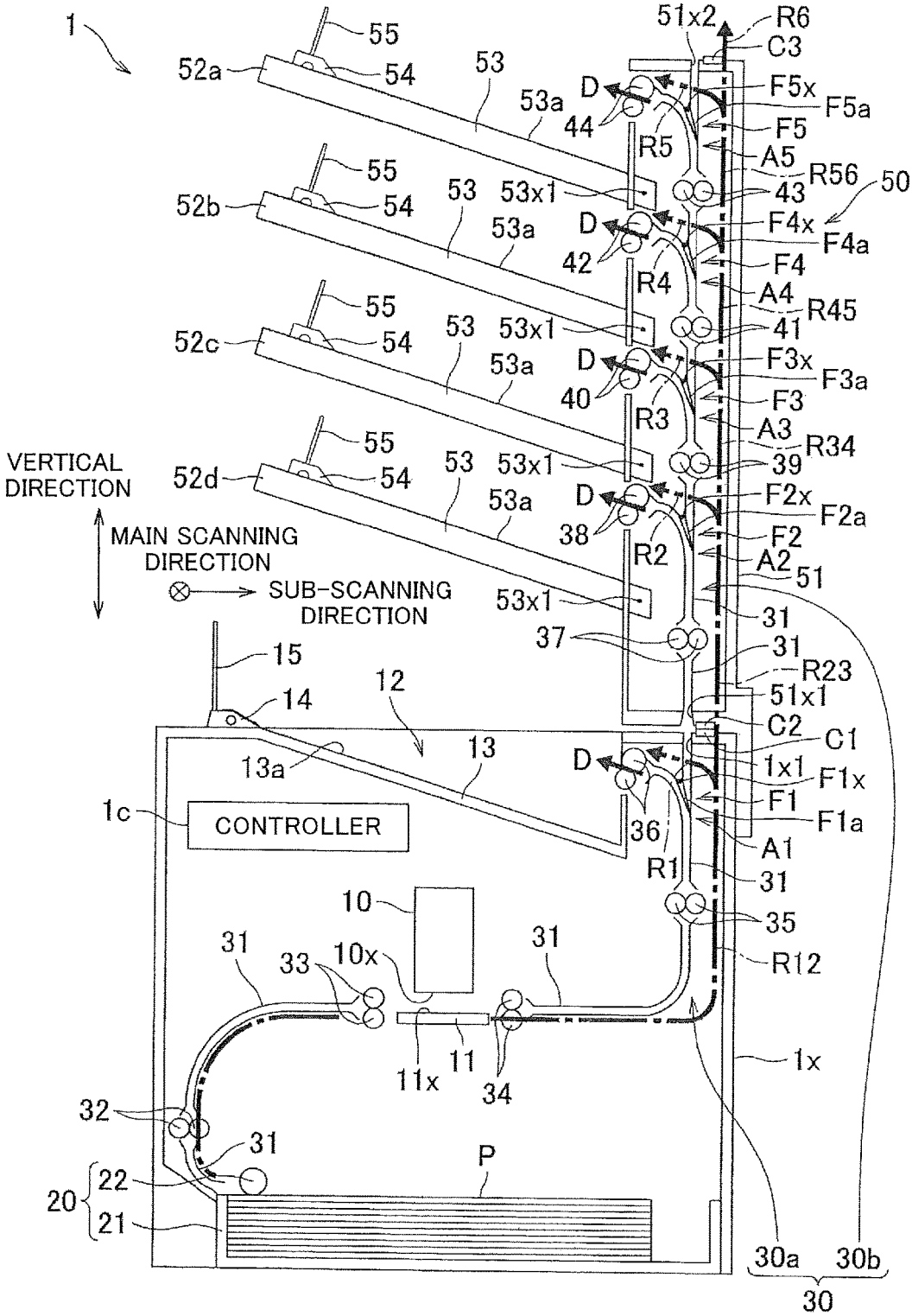
FIG. 2 is a schematic view of the ink-jet printer according to the first embodiment.

Hereinafter, there will be described embodiments by reference to the drawings. FIGS. 1 and 2 illustrate an ink-jet printer 1 according to a first embodiment. This ink-jet printer 1 is one example of a conveying apparatus and will be hereinafter simply referred to as "printer". As illustrated in FIGS. 1 and 2, the printer 1 includes a housing 1*x* having a substantially rectangular parallelepiped shape; and a tray unit 50 removably installed on the housing 1*x*. The tray unit 50 is disposed on an upper portion of the housing 1*x* such that an opening 1*x*1 formed in an upper surface of the housing 1*x* is opposed to an opening 51*x*1 formed in a lower surface of a supporter 51. Another tray unit may be additionally installed on an upper portion of the tray unit 50.

A receiving tray 12 is provided on the upper portion of the housing 1*x*.

The receiving tray 12 includes: a tray body 13 constituted by an upper board of the housing 1*x*; a base 14 removably mounted on the tray body 13; and a stopper 15 pivotable with respect to the base 14 about an axis extending in a main scanning direction. An upper surface of the tray body 13 serves as a receiving surface 13*a* for receiving a sheet P.

The tray unit 50 includes: four receiving trays 52*a*-52*d* arranged in the vertical direction; the supporter 51 shaped like a housing and supporting the receiving trays 52*a*-52*d* so as to enable an swing operation of each of the receiving trays 52*a*-52*d* about an axis 53*x*1 extending in the main scanning direction; and a swing mechanism 60 (see FIG. 5A) configured to swing each of the receiving trays 52*a*-52*d* with respect to the supporter 51. The receiving tray 52*a* is an uppermost tray located at the highest position among the receiving trays 52*a*-52*d*. The receiving trays 52*b*-52*d* are lower trays. The receiving tray 52*d* is the lowest tray located at the lowest position among the receiving trays 52*a*-52*d*.

Each of the receiving trays 52*a*-52*d* includes: a tray body 53 shaped like a plate having a groove 53*y* in its upper surface; a base 54 removably mounted on the tray body 53 in the groove 53*y* so as to be movable in a conveying direction D in which the sheet P is discharged onto the receiving tray; and a stopper 55 pivotable with respect to the base 54 about an axis extending in the main scanning direction. An upper surface of the tray body 53 serves as a receiving surface 53*a* for receiving the sheet P.

Projective regions X are formed by projecting the receiving surfaces 13*a*, 53*a* of the respective receiving trays 12, 52*a*-52*d* in the vertical direction onto a virtual plane orthogonal to the vertical direction, and these projective regions X overlap each other.

The tray body 53 has opposite side surfaces which extend in the conveying direction D so as to define the groove 53*y*. A multiplicity of recesses 53*z* are formed in each of these opposite side surfaces and arranged in the conveying direction D. A pair of protrusions, not illustrated, are provided respectively on outer side surfaces of the base 54 in the main scanning direction. These protrusions are respectively fittable in any pair of the recesses 53*z* which are opposed to each other in the main scanning direction. When the pair of protrusions are respectively fitted in the pair of recesses 53*z*, the base 54 is positioned with respect to the tray body 53.

The supporter 51 covers an upstream end portion of each of the receiving trays 52*a*-52*d* in the conveying direction D to prevent a user from taking out the sheet P from the receiving surface 53*a* in the main scanning direction.

The housing 1*x* contains an ink-jet head 10, a platen 11, a sheet-supply mechanism 20, a conveying mechanism 30*a*, and a controller 1*c*. A conveying mechanism 30*b* is provided in the supporter 51.

The head 10 has a substantially rectangular parallelepiped shape elongated in the main scanning direction. That is, the printer 1 is a line ink-jet printer. The head 10 includes: a passage unit including ink passages respectively having pressure chambers; and actuators each configured to apply a pressure to a corresponding one of the pressure chambers of the passage unit. A lower surface of the head 10, i.e., a lower surface of the passage unit, serves as an ejection surface 10*x* having a multiplicity of ejection openings for ink ejection. The ink is supplied to the ink passages of the passage unit from a cartridge, not illustrated.

The platen 11 is disposed under the head 10. The platen 11 has a planar plate shape and has a support surface 11*x* for supporting the sheet P. The support surface 11*x* is spaced apart from the ejection surface 10*x* in the vertical direction so as to face the ejection surface 10*x*.

The sheet-supply mechanism 20 includes: a storage tray 21 removably inserted in the housing 1*x* and capable of storing a plurality of the sheets P; and a sheet-supply roller 22 mounted on the storage tray 21. The controller 1*c* drives a sheet-supply motor 20M (see FIG. 3) to rotate the sheet-supply roller 22. The sheet-supply roller 22 contacts an uppermost one of the sheets P stacked on the storage tray 21. In this state, the sheet-supply roller 22 is rotated to supply the sheet P.

The conveying mechanism 30*a* and the conveying mechanism 30*b* constitute a conveying mechanism 30. The conveying mechanism 30 conveys the sheet P such that the sheet P supplied from the sheet-supply mechanism 20 is conveyed through an area between the ejection surface 10*x* and the support surface 11*x* and selectively received by one of the receiving trays 12, 52*a*-52*d* and receiving trays of another tray unit disposed on the upper portion of the tray unit 50. The conveying mechanism 30 defines paths R1-R6.

The path R1 is a path through which the sheet P is conveyed toward the receiving tray 12. The path R2 is a path through which the sheet P is conveyed toward the receiving tray 52*d*. The path R3 is a path through which the sheet P is conveyed toward the receiving tray 52*c*. The path R4 is a path through which the sheet P is conveyed toward the receiving tray 52*b*. The path R5 is a path through which the sheet P is conveyed toward the receiving tray 52*a*. The path R6 is a path through the sheet is conveyed toward one of the receiving trays of said another tray unit through an opening 51*x*2 formed in an upper surface of the supporter 51.

The paths R1, R2 share a common path R12 and branch off from this common path R12 at its one end, namely, a branch position A1. The paths R2, R3 share a common path R23 and branch off from this common path R23 at its one end, namely, a branch position A2. The paths R3, R4 share a common path R34 and branch off from this common path R34 at its one end, namely, a branch position A3. The paths R4, R5 share a common path R45 and branch off from this common path R45 at its one end, namely, a branch position A4. The paths R5, R6 share a common path R56 and branch off from this common path R56 at its one end, namely, a branch position A5.

The conveying mechanism 30*a* includes a guide 31 and roller pairs 32-36. The conveying mechanism 30*b* includes the guide 31 and roller pairs 37-44.

The guide 31 is disposed so as to be opposed to front and back surfaces of the sheet P conveyed along the paths R1-R6.

The roller pairs 32-36 are arranged along the path R1. The roller pairs 37, 38 are arranged along the path R2 branching off from the common path R12. The roller pairs 39, 40 are arranged along the path R3 branching off from the common path R23. The roller pairs 41, 42 are arranged along the path R4 branching off from the common path R34. The roller pairs 43, 44 are arranged along the path R5 branching off from the common path R45.

The controller 1*c* drives a conveying motor 30*a*M (see FIG. 3) to rotate the roller pairs 32-36. The controller 1*c* drives a conveying motor 30*b*M (see FIG. 3) to rotate the roller pairs 37-44. The rollers of each of the roller pairs 32-44 are rotated while nipping the sheet P to convey the sheet P.

Switchers F1-F5 are provided at the respective branch positions A1-A5 to switch a destination of the sheet P at the respective branch positions A1-A5. The switchers F1-F5 respectively include movable members F1*a*-F5*a* pivotable respectively about pivot shafts F1*x*-F5*x* each extending in the main scanning direction.

The controller 1*c* drives a switching motor F1M (see FIG. 3) to pivot the movable member F1*a* between a position (see FIG. 1) at which the movable member F1*a* guides the sheet P from the common path R12 to the path R1 and a position at which the movable member F1*a* guides the sheet P from the common path R12 to the path R2. The controller 1*c* drives a switching motor F2M (see FIG. 3) to pivot the movable member F2*a* between a position (see FIG. 1) at which the movable member F2*a* guides the sheet P from the common path R23 to the path R2 and a position at which the movable member F2*a* guides the sheet P from the common path R23 to the path R3. The controller 1*c* drives a switching motor F3M (see FIG. 3) to pivot the movable member F3*a* between a position (see FIG. 1) at which the movable member F3*a* guides the sheet P from the common path R34 to the path R3 and a position at which the movable member F3*a* guides the sheet P from the common path R34 to the path R4. The controller 1*c* drives a switching motor F4M (see FIG. 3) to pivot the movable member F4*a* between a position (see FIG. 1) at which the movable member F4*a* guides the sheet P from the common path R45 to the path R4 and a position at which the movable member F4*a* guides the sheet P from the common path R45 to the path R5. The controller 1*c* drives a switching motor F5M (see FIG. 3) to pivot the movable member F5*a* between a position (see FIG. 1) at which the movable member F5*a* guides the sheet P from the common path R56 to the path R5 and a position at which the movable member F5*a* guides the sheet P from the common path R56 to the path R6.

Figure 3:
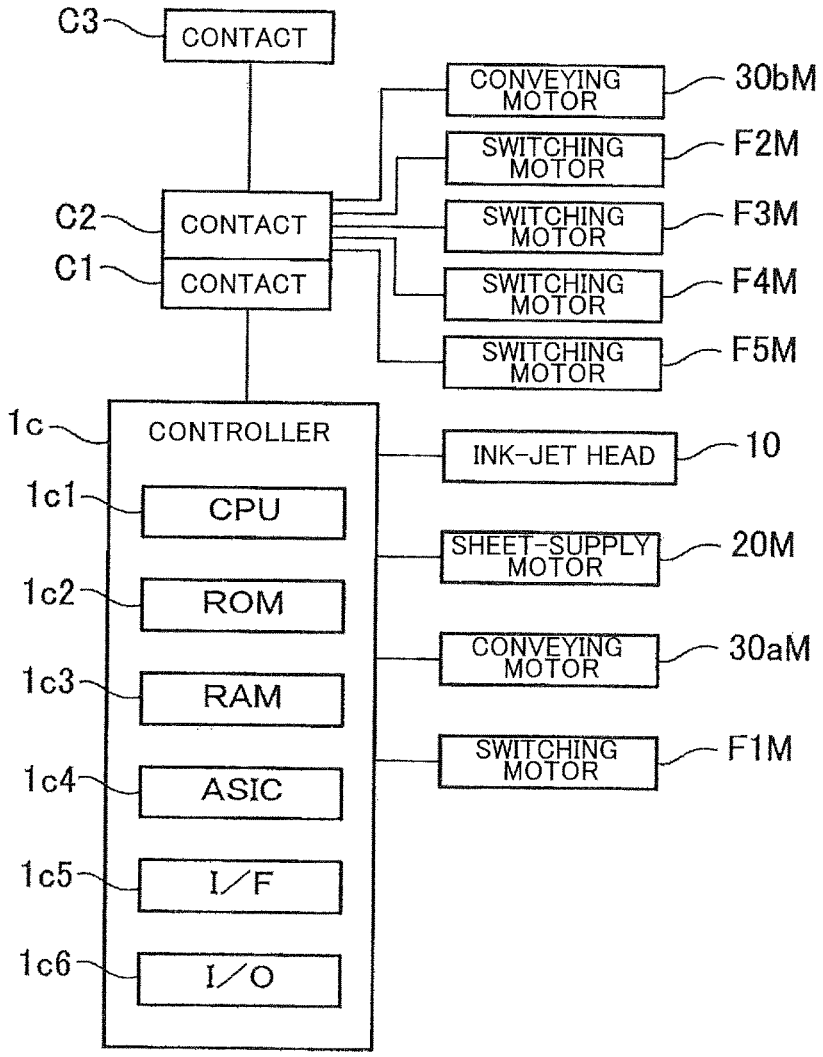
FIG. 3 is a block diagram illustrating an electric configuration of the ink-jet printer according to the first embodiment.

As illustrated in FIG. 3, the controller 1*c* includes: a central processing unit (CPU) 1*c*1 as a computing device; a read only memory (ROM) 1*c*2, a random access memory (RAM) 1*c*3, an application specific integrated circuit (ASIC) 1*c*4, an interface (I/F) 1*c*5, and an input/output port (I/O) 1*c*6. The ROM 1*c*2 stores fixed data used for programs to be executed by the CPU 1*c*1, for example. The RAM 1*c*3 temporarily stores data required for the CPU 1*c*1 to execute the programs. The ASIC 1*c*4 executes rewriting and sorting of image data and other processings such as a signal processing and an image processing. The interface 1*c*5 transmits and receives data to and from an external device such as a PC connected to the printer 1. The input/output port 1*c*6 transmits and receives signals to and from various kinds of sensors. The CPU 1*c*1 is electrically connected to the devices of the controller 1*c* other than the CPU 1*c*1 and executes control based on data received from the devices.

The controller 1*c* is electrically connected to a contact C1 provided on the upper surface of the housing 1*x*. When the tray unit 50 is installed on the housing 1*x*, the contact C1 and a contact C2 provided on the lower surface of the supporter 51 are brought into contact with each other and thereby electrically connected to each other. The contact C2 is electrically connected to the conveying motor 30*b*M and the switching motors F2M-F5M of the tray unit 50. This connection enables transfer of signals between the controller 1*c* and the conveying motor 30*b*M and the switching motors F2M-F5M of the tray unit 50.

When another tray unit is installed on the upper portion of the tray unit 50, a contact C3 provided on the upper surface of the supporter 51 of the tray unit 50 and another contact provided on a lower surface of a supporter of said another tray unit are brought into contact with each other and thereby electrically connected to each other. Said another contact is electrically connected to a conveying motor and switching motors of said another tray unit. This connection enables transfer of signals between the controller 1*c* and the conveying motor and the switching motors of said another tray unit.

When the sheet P conveyed by the conveying mechanism 30 passes through the area between the ejection surface 10*x* and the support surface 11*x*, the controller 1*c* controls the actuators of the head 10 to selectively eject the ink from the ejection openings to the sheet P. As a result, an image is formed on the sheet P. That is, image recording is performed on the sheet P. After the image recording, the sheet P is further conveyed by the conveying mechanism 30 and selectively received by one of the receiving trays 12, 52*a*-52*d*.

When the sheet P is received by one of the receiving trays 12, 52*a*-52*d*, the sheet P is conveyed in the conveying direction D, and then its leading end is brought into contact with a corresponding one of the stoppers 15, 55, so that the sheet P falls to a corresponding one of the receiving surfaces 13*a*, 53*a* of the respective receiving trays 12, 52*a*-52*d*.

Figure 4A:
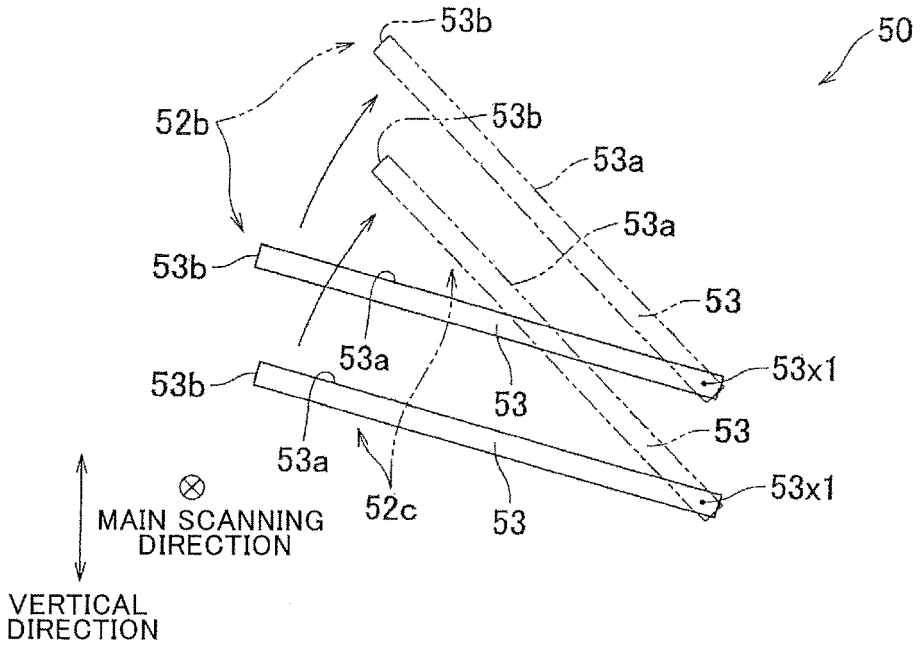
FIG. 4A is a side view of two receiving trays of a tray unit, illustrating their respective receiving positions and upper positions in the ink-jet printer according to the first embodiment, the receiving trays being arranged in the vertical direction with no tray in between, and FIG. 4B is a side view of the tray unit, illustrating a state in which its third receiving tray from the top is moved from the receiving position to the upper position in the ink-jet printer according to the first embodiment.
Figure 4B:
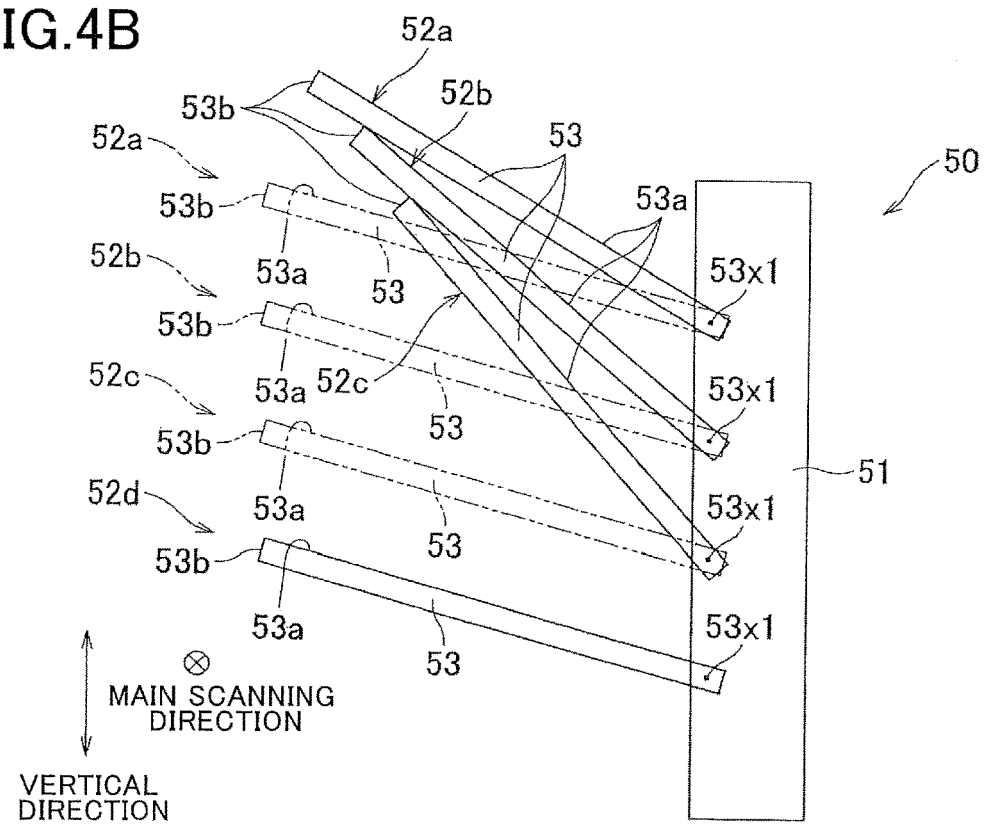

There will be next explained, with reference to FIGS. 4A and 4B, positions of each of the receiving trays 52*a*-52*d* swung with respect to the supporter 51. It is noted that FIGS. 4A and 4B omit illustration of the groove 53*y*, the recesses 53*z*, the base 54, and the stopper 55 of each of the receiving trays 52*a*-52*d*.

Each of the receiving trays 52*a*-52*d* is swung with respect to the supporter 51 so as to be positioned to any of a receiving position, an upper position, and an intermediate position. Each of the receiving trays 52*a*-52*d* is located at the receiving position when the receiving tray receives the sheet P conveyed by the conveying mechanism 30. The receiving position is indicated by the solid lines of the receiving trays 52*b*, 52*c* in FIG. 4A. When each of the receiving trays 52*a*-52*d* is located at the upper position, a downstream end 53*b* of the tray body 53 in the conveying direction D is located at a higher position than when the receiving tray is located at the receiving position. The upper position is indicated by the two-dot chain lines of the receiving trays 52*b*, 52*c* in FIG. 4A. When each of the receiving trays 52*a*-52*d* is located at the intermediate position, the downstream end 53*b* is located at a higher position than when the receiving tray is located at the receiving position, and is located at a lower position than when the receiving tray is located at the upper position. The intermediate position is any position between the position indicated by the solid line and the position indicated by the two-dot chain line in the case of each of the receiving trays 52*b*, 52*c* illustrated in FIG. 4A. When each of the receiving trays 52*a*-52*d* is located at the receiving position, the receiving surface 53*a* is inclined so as to be higher at its downstream portion than at its upstream portion in the conveying direction D.

In the case where one of the lower trays (the receiving tray 52*c* in FIG. 4A) is moved from the receiving position to the upper position via the intermediate position, the lower tray is moved through a corresponding path. At least a portion of the receiving tray disposed just above the lower tray and located at the receiving position (the receiving tray 52*b* indicated by the solid line in FIG. 4A) and at least a portion of the receiving tray disposed just above the lower tray and located at the intermediate position (the receiving tray 52*b* located between the position indicated by the solid line and the position indicated by the two-dot chain line in FIG. 4A) are located on the path. However, the receiving tray (the receiving tray 52*b* indicated by the two-dot chain line in FIG. 4A) disposed just above the lower tray and located at the upper position is not located on the path. In the example illustrated in FIG. 4B, portions of the receiving trays 52*a*, 52*b* each located at the receiving position and portions of the receiving trays 52*a*, 52*b* each located at the intermediate position are located on the path of the movement of the receiving tray 52*c*, and no portion of the receiving trays 52*a*, 52*b* each located at the upper position is located on the path of the movement of the receiving tray 52*c*.

In a process in which each of the receiving trays 52*b*-52*d* (the lower trays) is moved from the receiving position to the upper position, the lower tray is brought into contact with the receiving tray (the upper tray) directly above the lower tray, and the upper tray is moved from the receiving position to the intermediate position in a state in which the upper tray is supported by the lower tray. In the example illustrated in FIG. 4B, in a process in which the receiving tray 52*c* is moved from the receiving position to the upper position, the receiving tray 52*c* is brought into contact with the receiving tray 52*b* (the upper tray), and the receiving tray 52*b* is moved from the receiving position to the intermediate position in a state in which the receiving tray 52*b* is supported by the receiving tray 52*c*. In this movement, the receiving tray 52*a* disposed just above the receiving tray 52*b* is also moved from the receiving position to the intermediate position in a state in which the receiving tray 52*a* is supported by the receiving tray 52*b*. It is noted that an expression "the receiving tray (the upper tray) disposed directly above or just above the receiving tray (the lower tray)" means the receiving tray (the upper tray) disposed just above the receiving tray (the lower tray), with no receiving tray interposed therebetween.

Figure 5A:
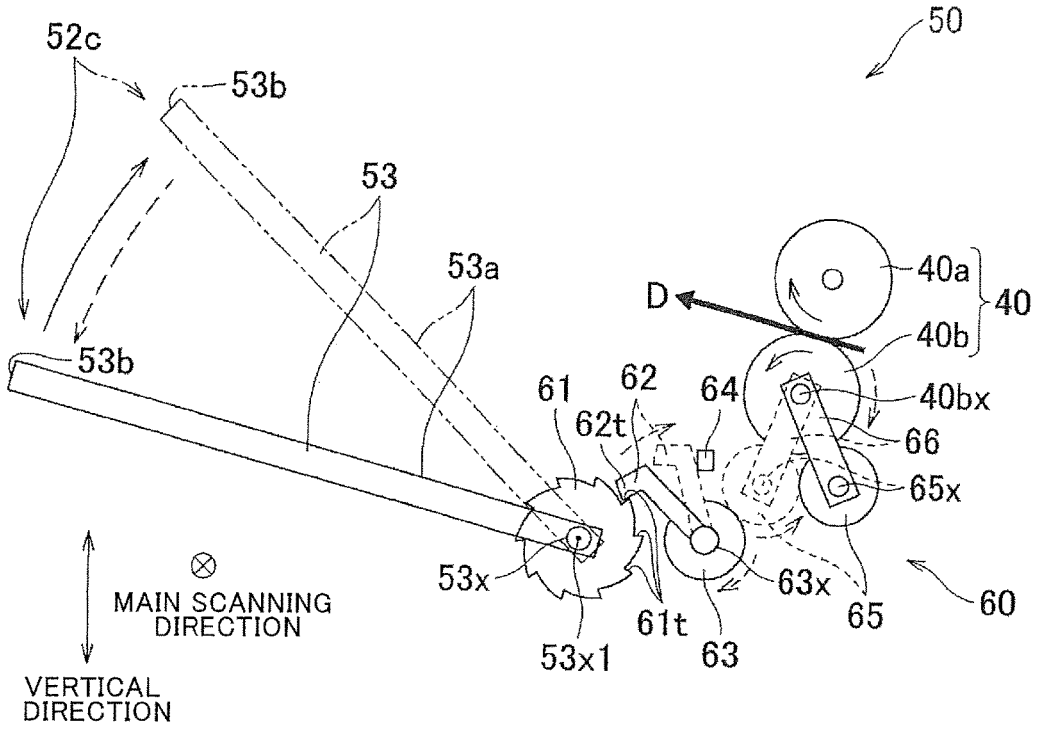
FIG. 5A is a side view of the third receiving tray from the top and a swing mechanism in the ink-jet printer according to the first embodiment.

There will be next explained a structure of the swing mechanism 60 with reference to FIG. 5. Like FIG. 4, FIG. 5A omits illustration of the groove 53*y*, the recesses 53*z*, the base 54, and the stopper 55 of the receiving tray 52*c*. While FIG. 5A illustrates components of the swing mechanism 60 provided for the receiving tray 52*c*, the same components are also provided for each of the receiving trays 52*a*, 52*b*, 52*d*.

For each of the receiving trays 52*a*-52*d*, as illustrated in FIG. 5A, the swing mechanism 60 includes: a ratchet wheel 61 fixed to a shaft 53*x* of the receiving tray; a pawl 62 engageable with the ratchet wheel 61; a roller 63 supporting the pawl 62 such that the pawl 62 is pivotable; a stopper 64 limiting an area of the pivotal movement of the pawl 62; a roller 65 contactable with the roller 63; and an arm 66 supporting the roller 65.

The ratchet wheel 61 is a gear with teeth each having a moderate slope on one edge and a steeper slope on the other edge. The steeper slope is hereinafter referred to as "steeply sloped edges 61*t*". The steeply sloped edges 61*t* of the respective teeth are uniformly spaced apart from each other around the shaft 53*x*. The pawl 62 has a protruding portion 62*t* selectively engageable with one of the steeply sloped edges 61*t*.

The roller 63 is supported near the ratchet wheel 61 by the supporter 51 so as to be rotatable about a rotation shaft 63*x* extending in the main scanning direction. The pawl 62 is fixed to the rotation shaft 63*x* and pivoted about the rotation shaft 63*x* by rotation of the roller 63. The pawl 62 is movable between an engagement position (indicated by the solid line in FIG. 5A) at which the pawl 62 is engaged with the ratchet wheel 61 and a non-engagement position (indicated by the broken line in FIG. 5A) at which the pawl 62 is not engaged with the ratchet wheel 61. The pawl 62 is urged by a spring, not illustrated, in a direction directed from the non-engagement position toward the engagement position, i.e., a counterclockwise direction indicated by the broken line arrow in FIG. 5A. When the pawl 62 is moved from the engagement position to the non-engagement position, the pawl 62 is brought into contact with the stopper 64 and stopped at a position at which the pawl is in contact with the stopper 64, i.e., the non-engagement position.

If the pawl 62 is to be further pivoted in the direction directed from the engagement position to the non-engagement position, i.e., the counterclockwise direction indicated by the broken-line arrow in FIG. 5A, after contacting the stopper 64, the pawl 62 may be damaged. To prevent this damage, for example, a torque limiter may be provided between the pawl 62 and the rotation shaft 63*x* to idle the pawl 62 with respect to the rotation shaft 63*x* due to a load imposed on the torque limiter after the contact of the pawl 62 with the stopper 64. In another example, a rotation speed of the conveying motor 30*b*M may be controlled to stop reverse rotation (S2) of the conveying motor 30*b*M, which will be described, when the pawl 62 is brought into contact with the stopper 64. In still another example, a sensor may be provided for the stopper 64 to stop the reverse rotation (S2) of the conveying motor 30*b*M based on a signal output from the sensor when the pawl 62 is brought into contact with the stopper 64.

For each of the receiving trays 52*a*-52*d*, one end of the arm 66 is fixed to a rotation shaft of one of two rollers of a roller pair disposed on the most downstream side in the conveying direction D on the path leading to the receiving tray. In the case of the receiving tray 52*c*, one end of the arm is fixed to a rotation shaft 40*bx* of a roller 40*b* of the roller pair 40 constituted by a roller 40*a* and the roller 40*b*. The arm 66 is pivoted about the rotation shaft by rotation of the one roller.

The roller 65 is supported by the other end of the arm 66 so as to be rotatable about a rotation shaft 65*x* extending in the main scanning direction. The pivotal movement of the arm 66 moves the roller 65 between a non-contact position (indicated by the solid line in FIG. 5A) at which the roller 65 does not contact the roller 63 and a contact position (indicated by the broken line in FIG. 5A) at which the roller 65 is in contact with the roller 63. The roller 65 is always in contact with the one roller (the roller 40*b* in the case of the receiving tray 52*c*) and is rotated by rotation of the one roller. When located at the contact position, the roller 65 transmits rotational power to the roller 63.

Figure 5B:
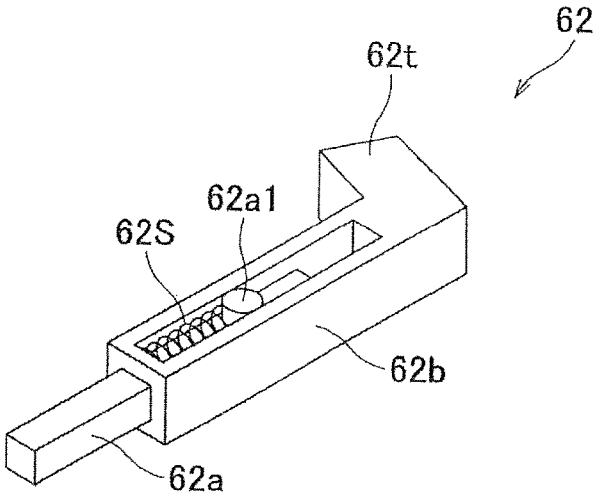
FIG. 5B is a perspective view of a pawl of the swing mechanism.

As illustrated in FIG. 5B, the pawl 62 includes: a slider 62*a*; a casing 62*b* containing a portion of the slider 62*a*; and a spring 62S disposed in the casing 62*b*. One end of the slider 62*a* is fixed to the rotation shaft 63*x*. The casing 62*b* contains the other end portion of the slider 62*a* and has the protruding portion 62*t* at a position far from the one end of the slider 62*a*. The slider 62*a* is movable with respect to the casing 62*b* in a direction orthogonal to the rotation shaft 63*x*. The movement of the slider 62*a* extends or contracts the pawl 62 in the direction orthogonal to the rotation shaft 63*x*. The spring 62S is disposed between a protrusion 62*a*1 provided on the slider 62*a* and a wall of the casing 62*b*. The spring 62S urges the slider 62*a* in a direction in which the pawl 62 is contracted in the direction orthogonal to the rotation shaft 63*x*.

When no external force larger than or equal to a threshold value is applied to the receiving tray in a state in which the pawl 62 is located at the engagement position (indicated by the solid line in FIG. 5A), the protruding portion 62*t* is kept in engagement with one of the steeply sloped edges 61*t*. The receiving tray is situated at any of the receiving position, the intermediate position, and the upper position, depending upon which steeply sloped edge 61*t* the protruding portion 62*t* is in engagement with among the steeply sloped edges 61*t*.

When an external force larger than or equal to the threshold value is applied to the receiving tray in a direction in which the receiving tray is moved from the receiving position to the upper position in a state in which the pawl 62 is located at the engagement position (indicated by the solid line in FIG. 5A), the ratchet wheel 61 is rotated in the clockwise direction in FIG. 5A with the shaft 53*x*. This rotation changes which steeply sloped edge 61*t* the protruding portion 62*t* is engaged with among the steeply sloped edges 61*t*, and the receiving tray is moved in the direction directed from the receiving position toward the upper position.

When an external force larger than or equal to the threshold value is applied to the receiving tray in the direction in which the receiving tray is moved from the upper position toward the receiving position in the state in which the pawl 62 is located at the engagement position (indicated by the solid line in FIG. 5A), the ratchet wheel 61 is rotated in the counterclockwise direction in FIG. 5A with the shaft 53*x*. This rotation applies, to the pawl 62, such a force that extends the pawl 62 in the direction orthogonal to the rotation shaft 63*x*. As a result, the pawl 62 is extended in the direction orthogonal to the rotation shaft 63*x* against an urging force of the spring 62S, so that the protruding portion 62*t* is disengaged from one of the steeply sloped edges 61*t*. When the protruding portion 62*t* is disengaged from one of the steeply sloped edges 61*t*, the pawl 62 is contracted by the urging force of the spring 62S in the direction orthogonal to the rotation shaft 63*x*, so that the protruding portion 62*t* comes into engagement with the steeply sloped edge 61*t* next to the one of the steeply sloped edges 61*t*. That is, the steeply sloped edge 61*t* to be engaged with the protruding portion 62*t* is changed one by one among the steeply sloped edges 61*t*, and the receiving tray is moved in the direction directed from the upper position toward the receiving position.

With the structure described above, the swing mechanism 60 keeps the receiving tray at the upper position when an external force larger than or equal to the threshold value is not applied to the receiving tray located at the upper position in the direction in which the receiving tray is moved from the upper position toward the receiving position. The swing mechanism 60 swings the receiving tray with respect to the supporter 51 toward the receiving position when an external force larger than or equal to the threshold value is applied to the receiving tray in the direction in which the receiving tray is moved from the upper position toward the receiving position.

Figure 6:
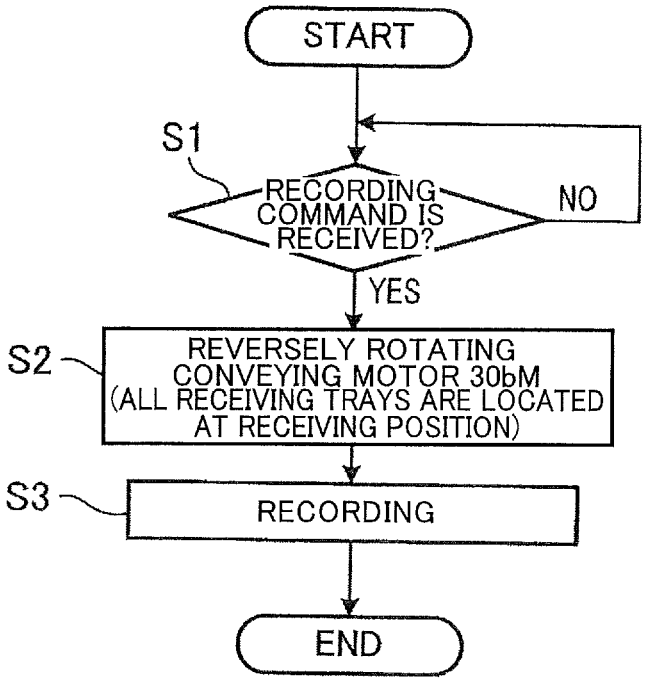
FIG. 6 is a flow chart illustrating a process to be executed by a controller in the ink-jet printer according to the first embodiment.

There will be next explained control of the swing mechanism 60 by the controller 1*c* with reference to FIG. 6.

Before start of control illustrated in FIG. 6, the pawl 62 is located at the engagement position (indicated by the solid line in FIG. 5A), the roller 65 is located at the non-contact position (indicated by the solid line in FIG. 5A), and each of the receiving trays 52*a*-52*d* is kept at any of the receiving position, the intermediate position, and the upper position by the swing mechanism 60.

This flow begins with S1 at which the controller 1*c* receives a recording command from an external device. When the recording command is not received (S1: NO), the controller 1*c* repeats the processing at S1. When the recording command is received (S1: YES), the controller 1*c* at S2 causes reverse rotation of the conveying motor 30*b*M. With this rotation, the roller pair disposed on the most downstream side in the conveying direction D on each of the paths extending toward the respective receiving trays 52*a*-52*d* is rotated in a direction reverse to a direction of its rotation during image recording. In the case of the receiving tray 52*c*, the roller pair 40 is rotated in a direction reverse to a direction indicated by the solid line in FIG. 5A. Furthermore, the arm 66 fixed to the rotation shaft of one of two rollers of the roller pair (the roller 40*b* in the case of the receiving tray 52*c*) is pivoted about the rotation shaft in the clockwise direction in FIG. 5A. This pivotal movement moves the roller 65 from the non-contact position to the contact position. Moreover, when the one of the two rollers (the roller 40*b* in the case of the receiving tray 52*c*) is rotated in the reverse direction, the roller 65 and the roller 63 are respectively rotated in the directions indicated by the broken-line arrows in FIG. 5A, so that the pawl 62 is moved from the engagement position (indicated by the solid line in FIG. 5A) to the non-engagement position (indicated by the broken line in FIG. 5A). As a result, the protruding portion 62*t* and the steeply sloped edge 61*t* are disengaged from each other, so that the receiving tray located at the upper position is moved by its own weight from the upper position to the receiving position. Similar operations are performed for the receiving tray located at the intermediate position. That is, when the conveying motor 30*b*M is rotated in the reverse direction, the pawl 62 is moved from the engagement position to the non-engagement position, which disengages the protruding portion 62*t* and the steeply sloped edges 61*t* from each other, so that the receiving tray is moved by its own weight from the intermediate position to the receiving position. The receiving tray located at the receiving position is kept at the receiving position without moving. With the operations described above, each of all the receiving trays 52*a*-52*d* is situated at the receiving position.

After the completion of the processing at S2, the controller 1*c* at S3 controls the components and devices of the printer 1 to perform image recording based on the recording command, and this flow ends.

In the present embodiment as described above, when taking out the sheet from any of the receiving trays 52*b*-52*d* (the lower trays), the user may increase the size of the working space by moving the receiving tray (the upper tray) disposed just above the lower tray from the receiving position to the upper position (see FIG. 4A). Moreover, since the swing mechanism 60 is provided, when the user takes out the sheet P from the upper tray after taking out the sheet P from the lower tray in the state in which the upper tray is situated at the upper position, the user can move the upper tray from the upper position back to the receiving position (see FIG. 5A) by applying, to the upper tray, an external force larger than or equal to the threshold value in the direction in which the upper tray is moved from the upper position to the receiving position. Accordingly, in the present embodiment, it is easy for the user to take out the sheet P from any of the upper tray and the lower trays.

The controller 1*c* controls the swing mechanism 60 based on the recording command such that one of the receiving trays 52*a*-52*d* which is located at the upper position and determined as a destination of the sheet P to be conveyed by the conveying mechanism 30 is moved from the upper position to the receiving position (at S2 in FIG. 6). When the image recording is performed in a state in which the receiving tray as the destination is situated at the upper position, a jam of the sheet P may occur. The construction in the present embodiment may reduce the possibility of occurrence of the jam.

The controller 1*c* controls the swing mechanism 60 based on the recording command such that all the receiving trays each located at the upper position among the receiving trays 52*a*-52*d* are moved from their respective upper positions to their respective receiving positions (at S2 in FIG. 6). In this control, all the receiving trays located at their respective upper positions are moved back to their respective receiving positions without exception, resulting in easy control.

The swing mechanism 60 is configured to: swing all the receiving trays 52*a*-52*d* other than at least the receiving tray 52*d* (the lowest tray), for example, all the receiving trays 52*a*-52*c* (each as one example of a second receiving tray) with respect to the supporter 51, such that each of all the receiving trays 52*a*-52*c* is to be situated to any of the receiving position and the upper position; keep each of the receiving trays 52*a*-52*c* at the upper position when no external force larger than or equal to the threshold value is applied to the receiving trays 52*a*-52*c* each located at the upper position in the direction in which each of the receiving trays 52*a*-52*c* is moved from the upper position to the receiving position; and swing each of the receiving trays 52*a*-52*c* with respect to the supporter 51 toward the receiving position when the above-described external force is applied to the receiving tray. This construction allows the user to easily take out the sheet P from any of the receiving trays 52*b*-52*d* (the plurality of lower trays).

The swing mechanism 60 is configured to: swing all the receiving trays 52*a*-52*d* with respect to the supporter 51 such that each of all the receiving trays 52*a*-52*d* is to be situated at any of the receiving position and the upper position; keep the receiving trays 52*a*-52*d* at their respective upper positions when no external force larger than or equal to the threshold value is applied to the receiving trays 52*a*-52*d* (each as one example of a third tray) including the lowest tray and located at their respective upper positions, in a direction in which the receiving trays 52*a*-52*d* are moved from their respective upper positions to their respective receiving positions; and swing each of the receiving trays 52*a*-52*d* with respect to the supporter 51 toward the receiving position when the above-described external force is applied to the receiving tray. With this configuration, the same construction may be employed to the receiving trays 52*a*-52*d* to simplify the construction of the printer 1. Also, a space occupied by the printer 1 can be reduced by situating all the receiving trays 52*a*-52*d* to their respective upper positions. Also, in the case where the printer 1 is provided with a plurality of the tray units 50, when the user takes out the sheet P from the uppermost tray (the receiving tray 52*a*) of the lower tray unit 50, the lowest tray (the receiving tray 52*d*) of the upper tray unit 50 may be moved from the receiving position to the upper position to increase the working space. Moreover, since the swing mechanism 60 is provided, when the user takes out the sheet P from the lowest tray (the receiving tray 52*d*) of the upper tray unit 50 after taking out the sheet P from the uppermost tray (the receiving tray 52*a*) of the lower tray unit 50, the user may apply an external force larger than or equal to the threshold value to the lowest tray (the receiving tray 52*d*) in a direction in which the lowest tray is moved from the upper position to the receiving position, to move the lowest tray from the upper position back to the receiving position. Accordingly, the above-described construction makes it easy for the user to take out the sheet P from any of the uppermost tray (the receiving tray 52*a*) of the lower tray unit 50 and the lowest tray (the receiving tray 52*d*) of the upper tray unit 50 in the case where the printer 1 is provided with a plurality of the tray units 50.

The swing mechanism 60 swings the receiving trays 52*a*-52*d* with respect to the supporter 51 (see FIGS. 4A and 4B) such that each of the receiving trays 52*a*-52*d* is situated at any of the receiving position, the upper position, and the intermediate position. On the path through which each of the receiving trays 52*b*-52*d* (the lower trays) is moved from the receiving position to the upper position via the intermediate position, there are at least a portion of the receiving tray disposed just above the lower tray and located at the receiving position and at least a portion of the receiving tray disposed just above the lower tray and located at the intermediate position. The receiving tray disposed just above the lower tray and located at the upper position is not located on the path. Thus, in the process in which each of the lower tray is moved from the receiving position to the upper position, the lower tray is brought into contact with the upper tray, and the upper tray is moved from the receiving position to the intermediate position while being supported by the lower tray. Accordingly, for example, when taking out the sheet P from the receiving tray 52*d* (the lowest tray), the user can move the receiving tray 52*c* (the upper tray) from the receiving position to the upper position to move each of the receiving trays 52*a*, 52*b* disposed above the receiving tray 52*c* from the receiving position to the intermediate position. This construction reliably forms a working space with a shorter distance between the receiving trays 52*a*, 52*d*.

Figure 7A:
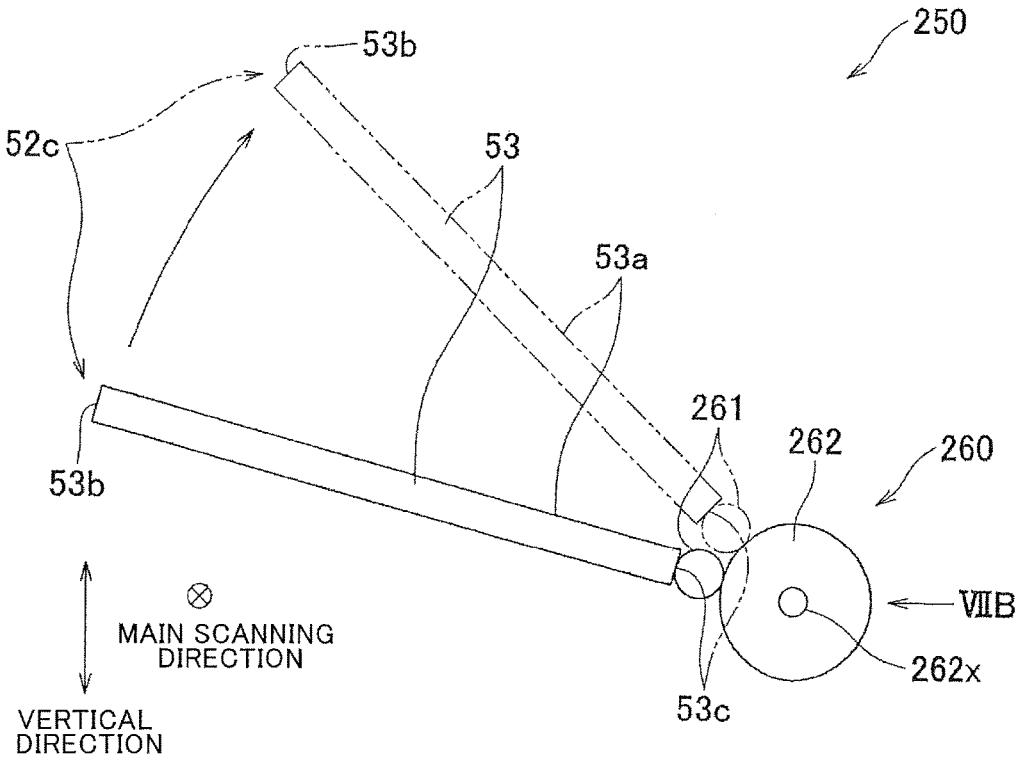
FIG. 7A is a side view of the third receiving tray from the top and a swing mechanism in an ink-jet printer according to a second embodiment.
Figure 7B:
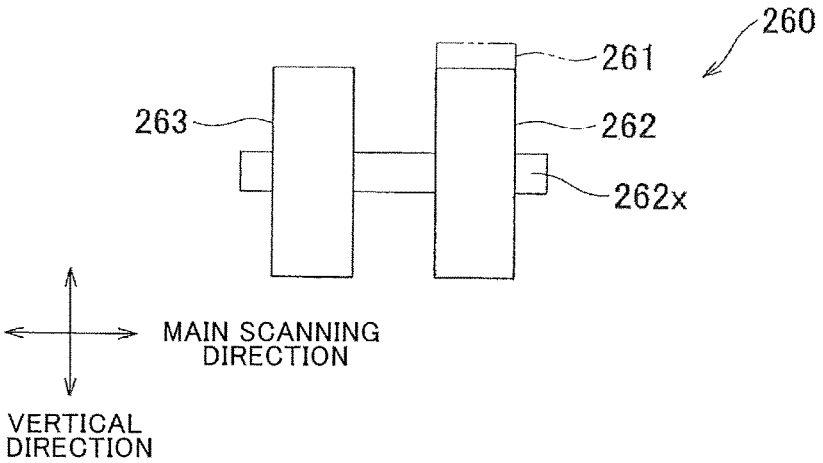
FIG. 7B is a view of the swing mechanism when the swing mechanism illustrated in FIG. 7A is viewed in the direction indicated by VIIB in FIG. 7A.
Figure 8:
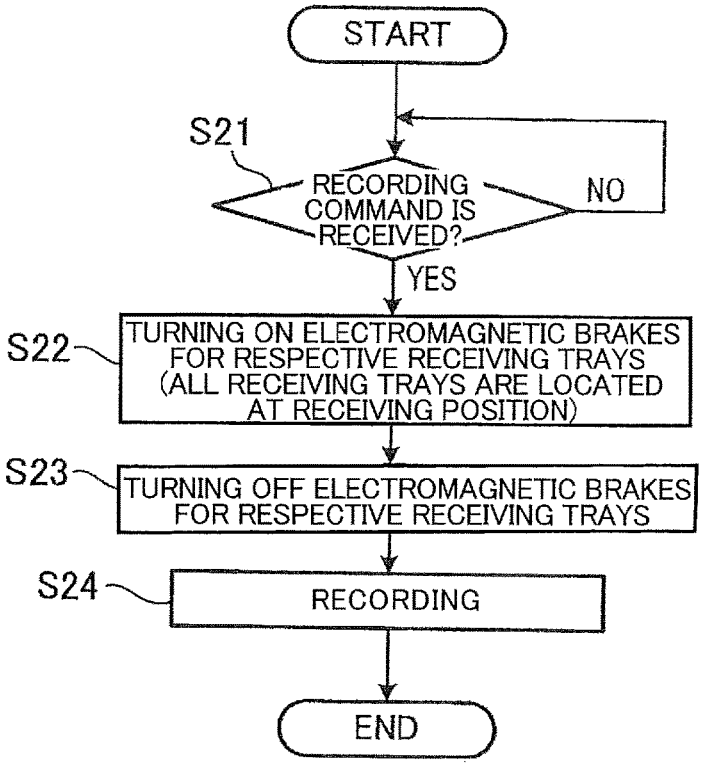
FIG. 8 is a flow chart illustrating a process to be executed by the controller in the ink-jet printer according to the second embodiment.

There will be next explained a second embodiment with reference to FIGS. 7A-8. A printer according to the second embodiment and the printer according to the first embodiment are different in construction of the swing mechanism and are the same in the other configuration. Like FIG. 5A, FIG. 7A omits illustration of the groove 53*y*, the recesses 53*z*, the base 54, and the stopper 55 of the receiving tray 52*c*. While FIG. 7A illustrates components of a swing mechanism 260 provided for the receiving tray 52*c*, the same components are also provided for each of the receiving trays 52*a*, 52*b*, 52*d*.

In a tray unit 250 according to the present embodiment, as illustrated in FIG. 7A, the swing mechanism 260 includes: a gear 261 provided on an upstream end 53*c* of each of the receiving trays 52*a*-52*d* in the conveying direction D; a sun gear 262 engaged with the gear 261 and rotatable about a rotation shaft 262*x* extending in the main scanning direction; and an electromagnetic brake 263 holding the rotation shaft 262*x* of the sun gear 262.

A one-way clutch is provided in the gear 261. Thus, the gear 261 is rotated in the clockwise direction in FIG. 7A (the direction for moving the receiving tray from the receiving position toward the upper position). The gear 261 however is not rotated in the counterclockwise direction in FIG. 7A (the direction for moving the receiving tray from the upper position toward the receiving position).

A torque limiter is provided in the sun gear 262. When an external force larger than or equal to the threshold value is applied to the receiving tray in the direction in which the receiving tray is moved from the upper position toward the receiving position, a holding force of the torque limiter is canceled, allowing the sun gear 262 to move the receiving tray in the above-described direction.

The electromagnetic brake 263 is turned on and off by the controller 1*c*. When the electromagnetic brake 263 is OFF, the sun gear 262 is locked with respect to the rotation shaft 262*x*. When the electromagnetic brake 263 is switched from OFF to ON, the sun gear 262 is unlocked with respect to the rotation shaft 262*x*.

When no external force larger than or equal to the threshold value is applied to the receiving tray in the state in which the electromagnetic brake 263 is OFF, the receiving tray is situated at any of the receiving position, the intermediate position, and the upper position.

When an external force larger than or equal to the threshold value is applied to the receiving tray in the direction in which the receiving tray is moved from the receiving position to the upper position in the state in which the electromagnetic brake 263 is OFF, the gear 261 is moved on a periphery of the locked sun gear 262 while being rotated in the clockwise direction in FIG. 7A, whereby the receiving tray is moved in the direction directed from the receiving position toward the upper position.

When an external force larger than or equal to the threshold value is applied to the receiving tray in the direction in which the receiving tray is moved from the upper position toward the receiving position in the state in which the electromagnetic brake 263 is OFF, the holding force of the torque limiter of the sun gear 262 is canceled, so that the receiving tray is moved in the direction directed from the upper position toward the receiving position.

When the electromagnetic brake 263 is switched from OFF to ON, the sun gear 262 is idled about the rotation shaft 262*x* by the gear 261 and the weight of the receiving tray (in the counterclockwise direction in FIG. 7A). As a result, the receiving tray is moved from the upper position or the intermediate position to the receiving position.

In the construction as described above, the swing mechanism 260 keeps each of the receiving trays 52*a*-52*d* at the upper position when no external force larger than or equal to the threshold value is applied to the receiving tray located at the upper position in the direction in which the receiving tray is moved from the upper position toward the receiving position. The swing mechanism 260 swings each of the receiving trays 52*a*-52*d* with respect to the supporter 51 toward the receiving position when an external force larger than or equal to the threshold value is applied to the receiving tray in the direction in which the receiving tray is moved from the upper position toward the receiving position.

There will be next explained control of the swing mechanism 260 by the controller 1*c* with reference to FIG. 8.

Before start of control illustrated in FIG. 8, the electromagnetic brake 263 is OFF, and each of the receiving trays 52*a*-52*d* is situated at any of the receiving position, the intermediate position, and the upper position by the swing mechanism 260.

The controller 1*c* at S21 determines whether a recording command is received from the external device. When the recording command is not received (S21: NO), the controller 1*c* repeats the processing at S21. When the recording command is received (S21: YES), the controller 1*c* at S22 switches the electromagnetic brakes 263 corresponding to the respective receiving trays 52*a*-52*d* from OFF to ON to situate all the receiving trays 52*a*-52*d* to their respective receiving positions. In this control, the receiving tray located at the upper position or the intermediate position is moved to the receiving position by idling of the sun gear 262. The receiving tray located at the receiving position is kept at the receiving position without moving.

After the completion of the processing at S22, the controller 1*c* at S23 switches the electromagnetic brakes 263 from ON to OFF. After the completion of the processing at S23, the controller 1*c* at S24 controls the components and devices of the printer 1 to perform image recording based on the recording command, and this flow ends.

In the present embodiment as described above, as in the first embodiment, when taking out the sheet from any of the receiving trays 52*b*-52*d* (the lower trays), the user may increase the size of the working space by moving the receiving tray (the upper tray) disposed just above the lower tray from the receiving position to the upper position. Moreover, since the swing mechanism 260 is provided, when the user takes out the sheet P from the upper tray after taking out the sheet P from the lower tray in the state in which the upper tray is situated at the upper position, the user can move the upper tray from the upper position back to the receiving position by applying, to the upper tray, an external force larger than or equal to the threshold value in the direction in which the upper tray is moved from the upper position to the receiving position. Accordingly, in the present embodiment, it is easy for the user to take out the sheet P from any of the upper tray and the lower trays as in the first embodiment.

The controller 1*c* controls the swing mechanism 260 based on the recording command such that one of the receiving trays 52*a*-52*d* which is located at the upper position and determined as a destination of the sheet P to be conveyed by the conveying mechanism 30 is moved from the upper position to the receiving position (at S22 in FIG. 8). When the image recording is performed in a state in which the receiving tray as the destination is situated at the upper position, a jam of the sheet P may occur. The construction in the present embodiment may reduce the possibility of occurrence of the jam.

The controller 1*c* controls the swing mechanism 260 based on the recording command such that all the receiving trays located at their respective upper positions among the receiving trays 52*a*-52*d* are moved from their respective upper positions to their respective receiving positions (at S22 in FIG. 8). In this control, all the receiving trays located at their respective upper positions are moved back to their respective receiving positions without exception, resulting in easy control.

Also in the present embodiment, the same configuration as employed in the first embodiment can achieve the same effects as obtained in the first embodiment.

Figure 9A:
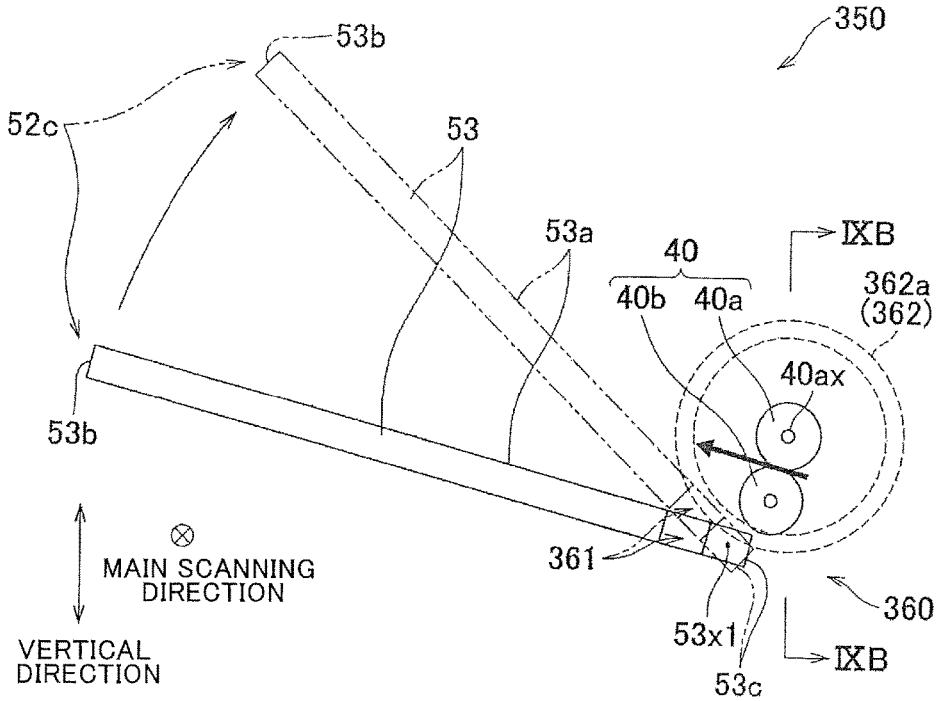
FIG. 9A is a side view of the third receiving tray from the top and a swing mechanism in an ink-jet printer according to a third embodiment.
Figure 9B:
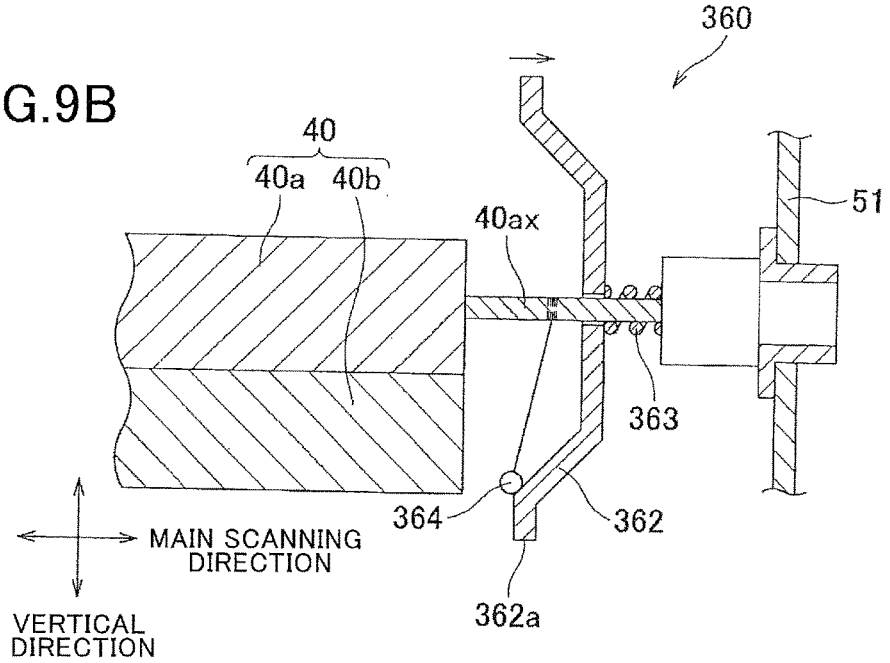
FIG. 9B is a cross-sectional view taken along line IXB-IXB in FIG. 9A.

There will be next explained a third embodiment with reference to FIGS. 9A and 9B. A printer according to the third embodiment and the printer according to the first embodiment are different in construction of the swing mechanism and are the same in the other configuration. Like FIG. 5A, FIG. 9A omits illustration of the groove 53*y*, the recesses 53*z*, the base 54, and the stopper 55 of the receiving tray 52*c*. While FIG. 9A illustrates components of a swing mechanism 360 provided for the receiving tray 52*c*, the same components are also provided for each of the receiving trays 52*a*, 52*b*, 52*d*.

In a tray unit 350 according to the present embodiment, as illustrated in FIG. 9, the swing mechanism 360 for each of the receiving trays 52*a*-52*d* includes: magnetic objects 361 provided near the upstream end 53*c* of the receiving tray in the conveying direction D; magnets 362 each shaped like a disc; coil springs 363; and pendulums 364.

The magnets 362 are supported by a rotation shaft of one of two rollers of the roller pair disposed on the most downstream side in the conveying direction D on each of the paths extending toward the respective receiving trays 52*a*-52*d*, so as to allow idling of the magnets 362. In the case of the receiving tray 52*c*, the magnets 362 are supported by a rotation shaft 40*ax* of the roller 40*a* of the roller pair 40 constituted by the two rollers 40*a*, 40*b*. In the case where the two rollers are constituted by a driving roller and a driven roller, the one of the two rollers is preferably the driving roller. Each of the coil springs 363 is wound around the rotation shaft so as to urge a corresponding one of the magnets 362 in a direction directed from a corresponding one of opposite outer portions toward an inner portion of the above-described rotation shaft. The pendulums 364 are provided on an inner side of the respective magnets 362 in the direction directed from the respective outer portions toward the inner portion of the rotation shaft. The pendulums 364 swing about the rotation shaft serving as a pivot. Each of the pendulums 364 applies a pressing force to the corresponding magnet 362 as will be described later to move the magnet 362 toward the corresponding outer portion of the rotation shaft.

For each of the receiving trays 52*a*-52*d*, the magnetic objects 361 are provided on opposite sides of the tray body 53 in the main scanning direction. The magnets 362, the coil springs 363, and the pendulums 364 are provided on opposite sides of the rotation shaft in the main scanning direction.

When no external force larger than or equal to the threshold value is applied to the receiving tray in a state in which each of the pendulums 364 applies no pressing force to the corresponding magnet 362, the magnetic objects 361 are held in contact with and attracted to peripheral portions 362*a* of the respective magnets 362, whereby the receiving tray located at the upper position is kept at the upper position.

It is noted that when the receiving tray is located at the intermediate position, the area of contact between the magnetic objects 361 and the respective magnets 362 is small, and accordingly the force of the magnets 362 for attracting the respective magnetic objects 361 is small. Thus, the receiving tray is moved to the receiving position without being kept at the intermediate position. That is, each of the receiving trays 52*a*-52*c* is kept at the intermediate position not by the swing mechanism 360 but by the receiving tray disposed just below the receiving tray and located at the upper position (see FIG. 4B).

When an external force larger than or equal to the threshold value is applied to the receiving tray located at the receiving position in the direction in which the receiving tray is moved from the receiving position to the upper position in the state in which each of the pendulums 364 applies no pressing force to the corresponding magnet 362, the receiving tray is swung about the axis 53*x*1 and moved from the receiving position to the upper position. In the process of this movement, the receiving tray located at the intermediate position is not kept at the intermediate position because the area of contact between the magnetic objects 361 and the respective magnets 362 is small, and the force of the magnets 362 for attracting the respective magnetic objects 361 is small as described above. When the receiving tray has reached the upper position, the area of contact between the magnetic objects 361 and the respective magnets 362 becomes larger, and the receiving tray is kept at the upper position by the attraction of the magnets 362 for the respective magnetic objects 361.

When an external force larger than or equal to the threshold value is applied to the receiving tray located at the upper position in the direction in which the receiving tray is moved from the upper position toward the receiving position in the state in which each of the pendulums 364 applies no pressing force to the corresponding magnet 362, the receiving tray is swung about the axis 53*x*1 and moved from the upper position to the receiving position. In the process of this movement, a relatively large external force is required to move the receiving tray against the attracting force of the magnets 362 at start of the movement, but when the receiving tray has reached the intermediate position, the force of the magnets 362 for attracting the respective magnetic objects 361 becomes smaller as described above. Thus, the receiving tray is swung by its own weight and moved to the receiving position.

In the construction described above, the swing mechanism 360 keeps the receiving tray at the upper position when no external force larger than or equal to the threshold value is applied to the receiving tray located at the upper position in the direction in which the receiving tray is moved from the upper position toward the receiving position. Also, the swing mechanism 360 swings the receiving tray with respect to the supporter 51 toward the receiving position when an external force larger than or equal to the threshold value is applied to the receiving tray in the direction in which the receiving tray is moved from the upper position toward the receiving position.

When the above-described rotation shaft (the rotation shaft 40*ax* of the roller 40*a* in the case of the receiving tray 52*c*) is rotated by the conveying mechanism 30 driven by the controller 1*c* based on the recording command, the pendulums 364 are rotated with the rotation of the above-described rotation shaft, so that a centrifugal force acts on each of the pendulums 364 such that the pendulum 364 is to be extended in a direction orthogonal to the rotation shaft, which applies a pressing force to each of the magnets 362 in a direction in which the magnet 362 is moved toward the outer end of the above-described rotation shaft. As a result, each of the magnets 362 is moved toward the outer end of the rotation shaft against the urging force of the coil spring 363 and separated from the magnetic object 361, whereby the force of the magnets 362 for attracting the respective magnetic objects 361 becomes smaller, thereby moving the receiving tray from the upper position to the receiving position. The receiving tray located at the receiving position is kept at the receiving position without moving.

In the present embodiment as described above, as in the first embodiment, when taking out the sheet from any of the receiving trays 52*b*-52*d* (the lower trays), the user may increase the size of the working space by moving the receiving tray (the upper tray) disposed just above the lower tray from the receiving position to the upper position. Moreover, since the swing mechanism 360 is provided, when the user takes out the sheet P from the upper tray after taking out the sheet P from the lower tray in the state in which the upper tray is situated at the upper position, the user can move the upper tray from the upper position back to the receiving position by applying, to the upper tray, an external force larger than or equal to the threshold value in the direction in which the upper tray is moved from the upper position to the receiving position. Accordingly, in the present embodiment, it is easy for the user to take out the sheet P from any of the upper tray and the lower trays as in the first embodiment.

In the present embodiment, each of the receiving trays 52*a*-52*c* is kept at the intermediate position not by the swing mechanism 360 but by the receiving tray disposed just below the receiving tray and located at the upper position. In this case, when the lower receiving tray is moved from the upper position back to the receiving position, the receiving tray located at the intermediate position is moved to the receiving position due to loss of its support by the lower receiving tray. Accordingly, there is no need for the user to perform an operation for moving the receiving tray from the intermediate position back to the receiving position.

Also in the present embodiment, the same construction as employed in the first embodiment can achieve the same effects as obtained in the first embodiment.

While the embodiments have been described above, it is to be understood that the disclosure is not limited to the details of the illustrated embodiments, but may be embodied with various changes and modifications, which may occur to those skilled in the art, without departing from the spirit and scope of the disclosure.

The stopper and the base may not be provided on the receiving tray. Also, the plurality of receiving trays may include at least one receiving tray that is not swung toward the receiving position when an external force larger than or equal to the threshold value is applied to the receiving tray in a direction in which the receiving tray is moved from the upper position to the receiving position. For example, the lowest tray may not be swung toward the receiving position when an external force larger than or equal to the threshold value is applied to the lowest tray in a direction in which the lowest tray is moved from the upper position to the receiving position. Also, the plurality of receiving trays may include at least one receiving tray fixed to the supporter. For example, the lowest tray may be fixed to the supporter.

The controller may control the swing mechanism to move only one of the receiving trays as a destination of the sheet P, from the upper position to the receiving position. The receiving tray disposed just above the lower tray and located at the receiving position and the receiving tray disposed just above the lower tray and located at the intermediate position may not be located on the path through which the lower tray is moved from the receiving position to the upper position via the intermediate position.

The threshold value for movement of the receiving tray in the direction in which the receiving tray is moved from the receiving position to the upper position and the threshold value for movement of the receiving tray in the direction in which the receiving tray is moved from the upper position toward the receiving position may or may not be the same as each other. In the first embodiment, since the pawl 62 needs to be extended against the urging force of the spring 62S so as to disengage the protruding portion 62*t* and the steeply sloped edges 61*t* from each other, the threshold value for movement of the receiving tray in the direction in which the receiving tray is moved from the upper position toward the receiving position is larger than the threshold value for movement of the receiving tray in the direction in which the receiving tray is moved from the receiving position to the upper position.

In the first embodiment, the printer 1 may be configured such that the pawl 62 is not extensible and contractable, and a torque limiter is provided between the ratchet wheel 61 and the shaft 53*x*. In this construction, an external force larger than or equal to the threshold value is applied to the receiving tray in the state in which the pawl 62 is located at the engagement position (indicated by the solid line in FIG. 5A), and even when the shaft 53*x* is rotated (that is, even when the receiving tray is swung), the protruding portion 62*t* of the pawl 62 is kept engaged with one of the steeply sloped edges 61*t* of the ratchet wheel 61 without rotation of the ratchet wheel 61 with the shaft 53*x*.

The conveying apparatus is not limited to the printer. Other examples of the conveying apparatus include a facsimile machine, a copying machine, and a multi-function peripheral (MFP). The recorder is not limited to the line recorder and may be a serial recorder. The recorder is not limited to the ink-jet recorder and may be a laser recorder and a thermal recorder, for example. The conveying apparatus may not include the recorder. The medium is not limited to the sheet and may be a cloth, for example. The medium is not limited to one on which image recording is performed and may be one on which image recording is not performed.

What is claimed is:

1. A conveying apparatus, comprising:

a plurality of receiving trays each having a receiving surface that receives a medium, the plurality of receiving trays being arranged in a vertical direction, the plurality of receiving trays comprising (i) a lowest tray located at a lowest position among the plurality of receiving trays and (ii) a first receiving tray that is each of at least one of the plurality of receiving trays and the at least one of the plurality of receiving trays does not include the lowest tray;

a conveying mechanism configured to convey the medium to the receiving surface of one of the plurality of receiving trays, selectively;

a supporter supporting the plurality of receiving trays;

a swing mechanism configured to swing the first receiving tray with respect to the supporter so as to move the first receiving tray selectively to one of a receiving position at which the first receiving tray receives the medium conveyed by the conveying mechanism and an upper position at which a position of a downstream end of the first receiving tray in a conveying direction in which the medium is conveyed by the conveying mechanism is higher than a position of the downstream end of the first receiving tray located at the receiving position, a position-keeper configured to keep the first receiving tray at the upper position when a first external force that is an external force directed in a direction in which the first receiving tray is moved from the upper position toward the receiving position is not applied to the first receiving tray located at the upper position, wherein the swing mechanism is configured to swing the first receiving tray with respect to the supporter toward the receiving position when the first external force is applied to the first receiving tray, and wherein the conveying apparatus further comprises a force-reducer configured to reduce a keeping force, of the position-keeper, so as to cease keeping the first receiving tray at the upper position, wherein the conveying apparatus further comprises:

a recorder configured to perform recording on the medium conveyed by the conveying mechanism; and a controller configured to, when a recording command for instructing the recorder to perform recording is received, control the position-keeper to move a destination receiving tray of the plurality of receiving trays from the upper position to the receiving position, the destination receiving tray being located at the upper position and serving as a destination to which the medium is to be conveyed by the conveying mechanism.

2. The conveying apparatus according to claim 1, wherein the controller is configured to control the position-keeper based on the recording command such that each of all receiving trays each located at the upper position among the plurality of receiving trays is moved from the upper position to the receiving position.

3. The conveying apparatus according to claim 1, wherein the plurality of receiving trays comprise a plurality of second receiving trays which are all of a plurality of receiving trays of the plurality of receiving trays other than the lowest tray, the plurality of second receiving trays including the first receiving tray, wherein the swing mechanism is configured to swing all the plurality of second receiving trays with respect to the supporter so as to move each of all the plurality of second receiving trays selectively to one of the receiving position and the upper position;

wherein the position-keeper is configured to keep each of the plurality of second receiving trays at the upper position when a second external force that is an external force directed in a direction in which said each of the plurality of second receiving trays is moved from the upper position toward the receiving position is not applied to said each of the plurality of second receiving trays which is located at the upper position;

wherein the swing mechanism is configured to swing said each of the plurality of second receiving trays with respect to the supporter toward the receiving position when the second external force is applied to said each of the plurality of second receiving trays, and wherein the force-reducer is configured to cease keeping the plurality of second receiving trays at the upper position.

4. The conveying apparatus according to claim 1, wherein the plurality of receiving trays comprise a third receiving tray that is each of at least one of the plurality of receiving trays which includes the lowest tray, wherein the swing mechanism is configured to swing all the plurality of receiving trays with respect to the supporter so as to move each of all the plurality of receiving trays selectively to one of the receiving position and the upper position;

wherein the position-keeper is configured to keep the third receiving tray at the upper position when a third external force that is an external force directed in a direction in which the third receiving tray is moved from the upper position toward the receiving position is not applied to the third receiving tray located at the upper position;

wherein the swing mechanism is configured to swing the third receiving tray with respect to the supporter toward the receiving position when the third external force is applied to the third receiving tray, and wherein the force-reducer is configured to cease keeping the third receiving tray at the upper position.

5. The conveying apparatus according to claim 1, wherein the swing mechanism is configured to swing each of the plurality of receiving trays with respect to the supporter so as to move said each of the plurality of receiving trays selectively to one of the receiving position, the upper position, and an intermediate position at which a position of a downstream end of said each of the plurality of receiving trays in the conveying direction is higher than a position of the downstream end of said each of the plurality of receiving trays which is located at the receiving position and lower than a position of the downstream end of said each of the plurality of receiving trays which is located at the upper position, and wherein the plurality of receiving trays comprise (i) an uppermost tray located at a highest position among the plurality of receiving trays and (ii) a lower tray that is one of the plurality of receiving trays other than the uppermost tray;

wherein at least a portion of one of the plurality of receiving trays which is disposed above the lower tray and located at the receiving position and at least a portion of the one of the plurality of receiving trays which is disposed above the lower tray and located at the intermediate position are located on a path through which the lower tray is moved from the receiving position to the upper position via the intermediate position, and the one of the plurality of receiving trays which is disposed above the lower tray and located at the upper position is not located on the path.

6. The conveying apparatus according to claim 5, wherein the plurality of receiving trays comprise a fourth receiving tray that is swung by the swing mechanism with respect to the supporter, wherein the fourth receiving tray is not kept at the intermediate position by the position-keeper and is kept at the intermediate position by contact with one of the plurality of receiving trays which is disposed under the fourth receiving tray and located at the upper position.

7. The conveying apparatus according to claim 1, wherein the plurality of receiving trays comprise (i) an uppermost tray located at a highest position among the plurality of receiving trays and (ii) a lower tray that is each of at least one of the plurality of receiving trays other than the uppermost tray;

wherein at least a portion of a projective region formed by projecting the receiving surface of the lower tray in the vertical direction onto a virtual plane orthogonal to the vertical direction overlaps a projective region formed by projecting any of at least one of the plurality of receiving trays which is disposed above the lower tray, onto the virtual plane in the vertical direction.

8. A tray unit used for a conveying apparatus, the conveying apparatus comprising (a) a plurality of receiving trays each having a receiving surface that receives a medium, the plurality of receiving trays being arranged in a vertical direction, (b) a conveying mechanism configured to convey the medium to the receiving surface of one of the plurality of receiving trays, selectively, (c) a supporter supporting the plurality of receiving trays, and (d) a recorder configured to perform recording on the medium conveyed by the conveying mechanism, the tray unit comprising:

the plurality of receiving trays comprising (i) a lowest tray located at a lowest position among the plurality of receiving trays and (ii) a first receiving tray that is each of at least one of the plurality of receiving trays and the at least one of the plurality of receiving trays does not include the lowest tray;

a swing mechanism configured to swing the first receiving tray with respect to the supporter so as to move the first receiving tray selectively to one of a receiving position at which the first receiving tray receives the medium conveyed by the conveying mechanism and an upper position at which a position of a downstream end of the first receiving tray in a conveying direction in which the medium is conveyed by the conveying mechanism is higher than a position of the downstream end of the first receiving tray located at the receiving position;

a position-keeper configured to keep the first receiving tray at the upper position when a first external force that is an external force directed in a direction in which the first receiving tray is moved from the upper position toward the receiving position is not applied to the first receiving tray located at the upper position; and wherein the swing mechanism is configured to swing the first receiving tray with respect to the supporter toward the receiving position when the first external force is applied to the first receiving tray, wherein the tray unit further comprises a force-reducer configured to reduce a keeping force, of the position-keeper, so as to cease keeping the first receiving tray at the upper position, and wherein, when a recording command for instructing the recorder to perform recording is received, the position-keeper moves a destination receiving tray of the plurality of receiving trays from the upper position to the receiving position, the destination receiving tray being located at the upper position and serving as a destination to which the medium is to be conveyed by the conveying mechanism.

9. The tray unit according to claim 8, wherein the plurality of receiving trays comprise a third receiving tray that is each of at least one of the plurality of receiving trays which includes the lowest tray, and wherein the swing mechanism is configured to swing all the plurality of receiving trays with respect to the supporter so as to move each of all the plurality of receiving trays selectively to one of the receiving position and the upper position;

wherein the position-keeper is configured to keep the third receiving tray at the upper position when a third external force that is an external force directed in a direction in which the third receiving tray is moved from the upper position toward the receiving position is not applied to the third receiving tray located at the upper position; and wherein the swing mechanism is configured to swing the third receiving tray with respect to the supporter toward the receiving position when the third external force is applied to the third receiving tray.

* * * * *